United States Patent [19]

Bains

[11] 4,200,028

[45] Apr. 29, 1980

[54] MULTI-PURPOSE GUN SAFETY

[75] Inventor: William R. Bains, Lake Elsinore, Calif.

[73] Assignee: The United States of America as represented by the Secretary of the Army, Washington, D.C.

[21] Appl. No.: 934,783

[22] Filed: Aug. 18, 1978

[51] Int. Cl.[2] ..... F41D 11/02

[52] U.S. Cl. ..... 89/142

[58] Field of Search ..... 42/70 C; 89/142, 148

[56] References Cited

U.S. PATENT DOCUMENTS

| | | | |
|---|---|---|---|
| 858,745 | 7/1907 | McClean | 89/142 |
| 861,939 | 7/1907 | Benet et al. | 89/142 |
| 933,098 | 9/1909 | McClean | 89/142 |
| 2,119,536 | 6/1938 | Green | 89/142 |

*Primary Examiner*—Stephen C. Bentley

*Attorney, Agent, or Firm*—Nathan Edelberg; Robert P. Gibson; Peter A. Taucher

[57] ABSTRACT

A safety mechanism for locking the bolt carrier of an automatic gun against movement in the counter recoil direction. The mechanism includes a swingable arm structure movable into the path of the gun trigger, and a back-up pawl structure engageable with the bolt carrier in the event of trigger malfunction or sear malfunction.

5 Claims, 4 Drawing Figures

MULTI-PURPOSE GUN SAFETY

The invention described herein may be manufactured, used, and licensed by or for the Government for governmental purposes without payment to me of any royalty thereon.

BACKGROUND AND SUMMARY OF THE INVENTION

This invention relates to an improvement on the automatic gun shown in U.S. Pat. No. 3,517,586 issued to E. M. Stoner on June 30, 1970. The principal object of the invention is to provide a safety mechanism that prevents depression of the trigger and additionally latches the bolt carrier in the recoil position under certain circumstances, e.g. when the sear fails or when the gun is not in use.

THE DRAWINGS

Since this invention is an improvement in an automatic gun disclosed more completely in U.S. Pat. No. 3,517,586, the present drawings and description will utilize the same reference numerals employed in that patent disclosure for similar components.

Figure 1:
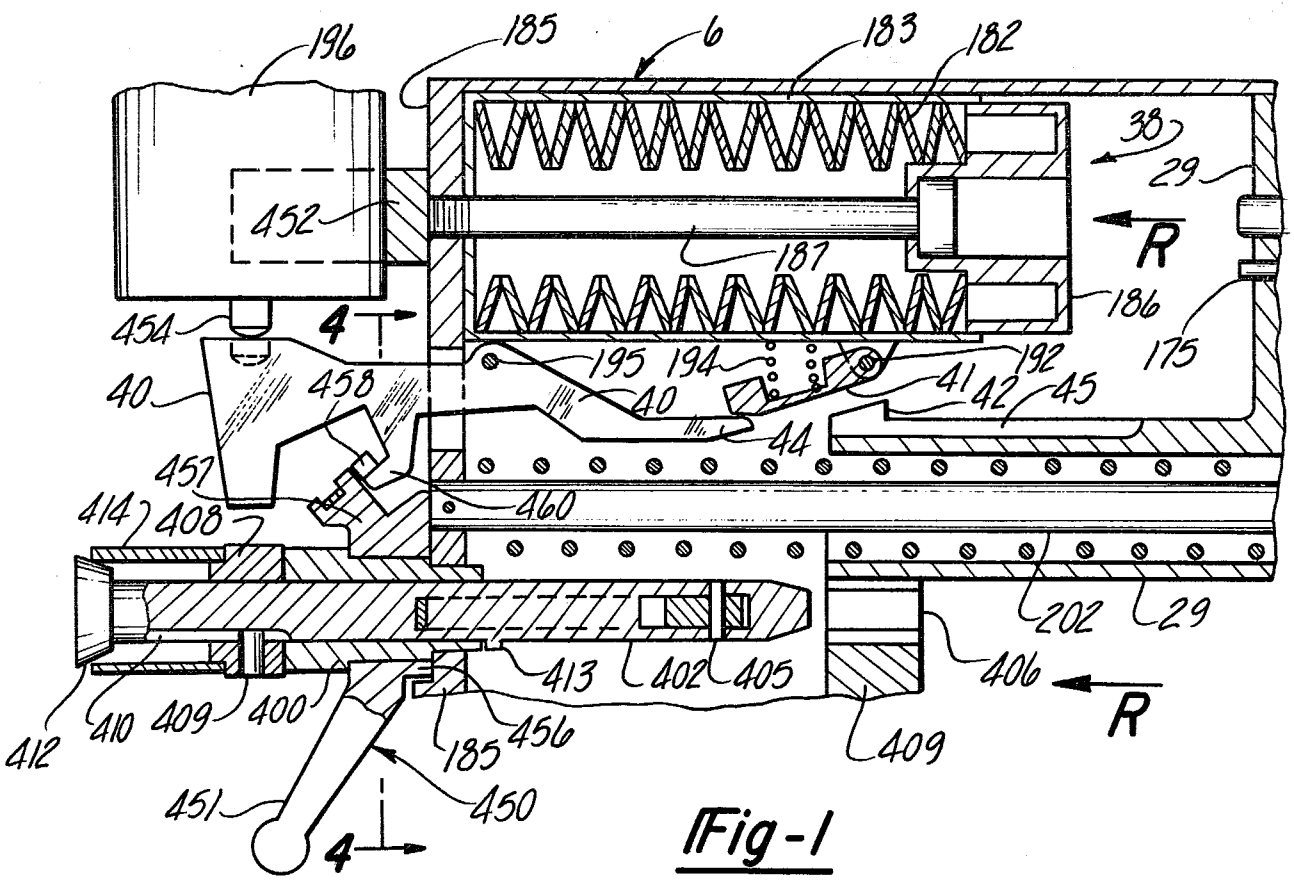
FIG. 1 is a fragmentary sectional view through the rear section of a gun embodying this invention.

The present drawings fragmentarily show an automatic gun that includes a receiver 6 having a rear wall 185 that mounts a buffer assembly designated generally by numeral 38. Said buffer assembly comprises a series of Belleville (coned disk) springs 182 contained within a surrounding sleeve 183. The spring disks are compressively retained within the sleeve by means of a plunger 186 and screw 187 threaded into receiver rear wall 185.

Buffer assembly 38 is intended to absorb the axial force of a bolt carrier 29 as said carrier moves rearwardly in the arrow R direction. Comparing FIGS. 1 and 2, it will be seen that in FIG. 1 bolt carrier 29 has not yet reached the buffer assembly 38, whereas in FIG. 2 the bolt carrier has reached the buffer assembly and has deflected the assembly to its maximum permitted deflection (limited by the front edge of sleeve 183).

Figure 2:
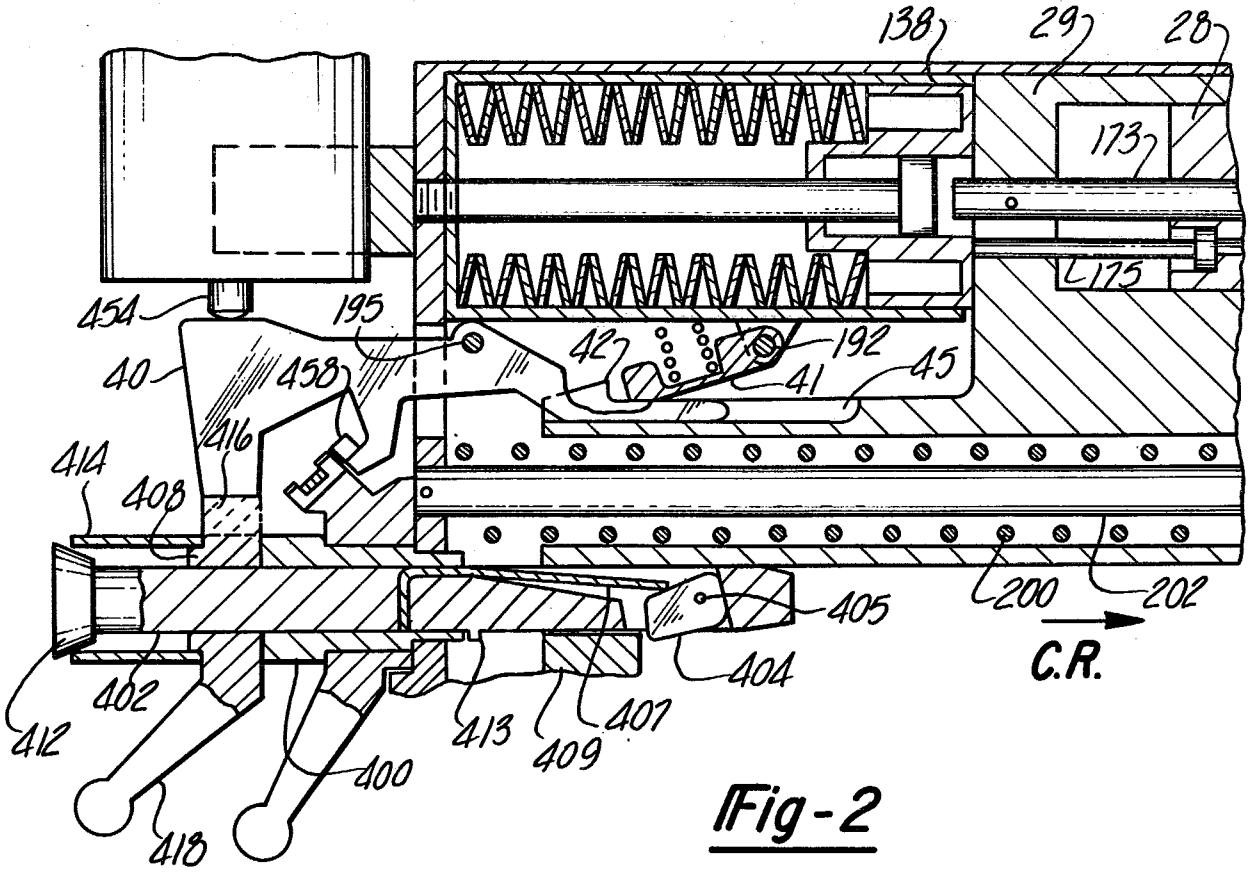
FIG. 2 is a view similar to FIG. 1, but with the bolt carrier 29 in a position slightly displaced rearwardly from the FIG. 1 position.

As the bolt carrier 29 moves toward the FIG. 2 position an upstanding shoulder 42 on the bolt carrier cams against the undersurface of a sear 41 that is swingably connected to sleeve 183 by means of a pivot pin 192; a compression spring 194 urges the sear downwardly to its FIG. 2 position after shoulder 42 is rearwardly beyond the sear. When the sear is in the FIG. 2 position the bolt carrier 29 is prevented from forward counter-recoil movement in the arrow C. R. direction. The sear is liftable from its FIG. 2 position by means of a trigger 40 swingably mounted in the receiver by means of a pivot pin 195. It will be seen that a downward force on the left (rear) portion of trigger 40 will produce an upward motion of the right (front) tip area 44, thereby lifting the sear 41 to a position above the path of shoulder 42. Trigger 40 is a plate structure that is receivable within a slot 45 when bolt carrier 29 is moving toward its FIG. 2 position; for a better visualization of slot 45 please refer to FIG. 27 of U.S. Pat. No. 3,517,586.

Trigger 40 can be operated either manually by means of a trigger control mechanism 450, or automatically by means of a solenoid 196. The solenoid is suitably mounted rearwardly of receiver 6, as by means of a yoke-like bracket 452. The plunger 454 of the solenoid is engaged with the upper surface of trigger 40 to reciprocate between the full line and dotted line positions when electrical pulses are delivered to the solenoid winding from a remote electrical power source, not shown. The frequency of the pulses can be controlled or varied by control circuits similar to those shown in U.S. Pat. No. 3,440,926.

Figure 4:
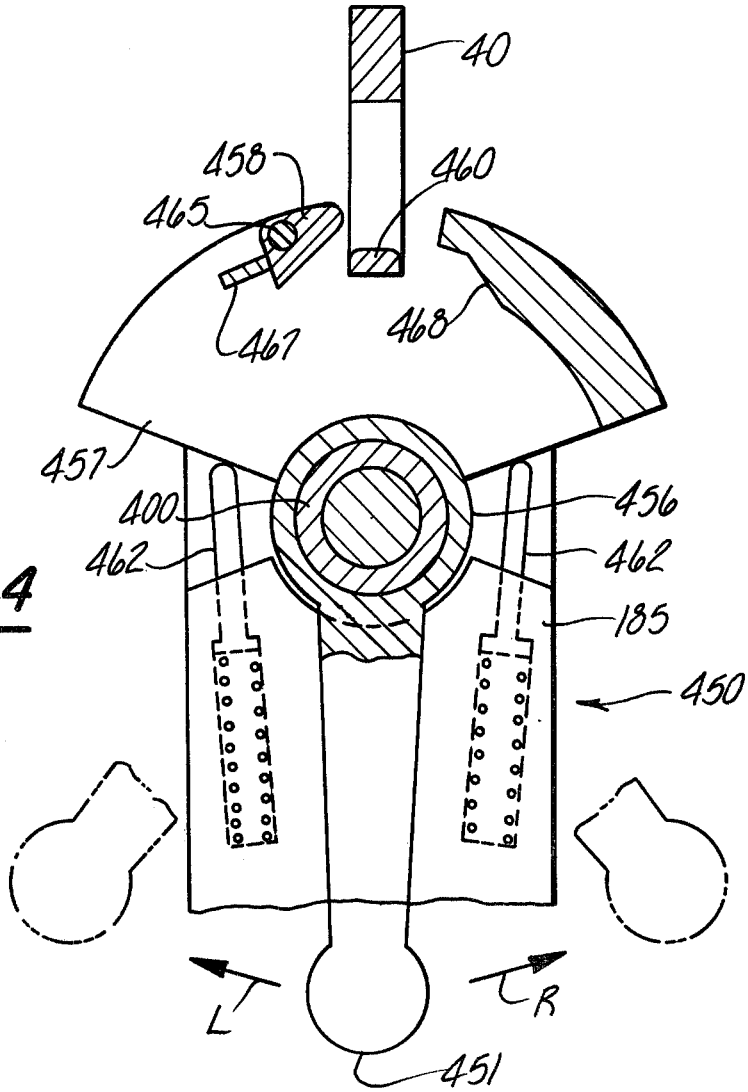
FIG. 4 is a fragmentary sectional view taken approximately on line 4—4 in FIG. 1, and illustrating a trigger control mechanism used therein.

The manual trigger control 450 comprises a tubular section 456 rotatably encircling a stationary bearing sleeve 400 affixed to receiver wall 185. A pivotal pawl 458 is swingably mounted on sector section 457 of the trigger control to overlie the depending wall portion 460 of trigger 40 when the trigger control handle 451 is in one of three positions. FIG. 4 shows the trigger control in its neutral position. When handle 451 is swung from the neutral position in a leftward direction (FIG. 4) the trigger control causes the gun to fire one shot. When handle 451 is swung from the neutral position in a rightward direction (FIG. 4) the gun is caused to fire repeatedly at a rate determined by the spring system within the gun. When the operator removes his hand from handle 451 the trigger control is automatically centered in the FIG. 4 full line (neutral) position; centering action is accomplished by two similar spring-urged plungers 462 slidably housed within wall 185 and engaged with edge surfaces of sector section 457. FIG. 4 is a semi-diagrammatic representation showing how trigger control 450 functions. The actual structure differs in minor respects from that shown in FIG. 4.

At this point I will briefly describe the possible actions when handle 451 is in each of its three positions. In the neutral position of handle 451 (FIG. 4) the trigger 40 is disconnected from trigger control 450. In the absence of force developed by solenoid 196 the trigger will be biased to the FIG. 2 position by the action of spring 194. When the bolt carrier 29 reaches the FIG. 2 position sear 41 engages shoulder 42 to prevent bolt carrier movement in the counter-recoil direction; this latching action prevents the gun from firing.

While the trigger control is in the neutral position it is possible to operate the gun automatically by pulse energization of solenoid 196. Incident to each pulse, the solenoid armature plunger 454 moves down, and trigger 40 moves counterclockwise to lift sear 41 out of the path of shoulder 42, thereby permitting the spring system at 182, 200 to move bolt carrier 29 forwardly to fire the gun. As the bolt carrier returns to the FIG. 2 position the sear 41 delays the next firing movement until trigger 40 has been moved counterclockwise by solenoid 196. The firing rate is therefore determined by the pulse frequency supplied to the solenoid.

When handle 451 is swung in a leftward direction (arrow L in FIG. 4) the lower surface of pawl 458 cams on the upper surface of trigger section 460; accordingly trigger 40 is moved downwardly (FIG. 4). As viewed in FIG. 2, trigger 40 moves in a counterclockwise direction to lift sear 41 out of engagement with shoulder 42. The stored forces in springs 200 and 182 cause the gun to fire a single shot. As handle 451 nears the limit of its leftward swing movement pawl 458 passes to the right of trigger section 460; the trigger is then biased in a clockwise direction by the spring-urged sear 41. The sear latches bolt carrier 29 in the FIG. 2 position after the gun has fired a single shot. When the soldier releases leftward pressure on handle 451 the plungers 462 (FIG. 4) return the trigger control to the neutral position. During this period pawl 458 trips on the upper surface of trigger section 460 without exerting any appreciable force thereon. A light hairspring (not shown) is trained around the pawl pivot shaft 465 to normally urge the pawl against a stop 467 on sector section 457.

When handle 451 is moved from the neutral position in a rightward direction (designated by letter R in FIG. 4) a cam surface 468 on sector section 457 forcibly engages trigger section 460, thereby moving the trigger in a counterclockwise direction (FIG. 2). As long as the technician holds handle 451 in its rightward position trigger 40 is effective to lift sear 41 out of the path of shoulder 42 on the bolt carrier. The gun will fire repeatedly at a rate determined by the characteristics of the springs 200 and 182.

The structure thus far described is already known. The present invention relates to a safety mechanism for restraining the trigger 40 in an inactive condition, and for latching the bolt carrier in its full recoil position. The safety mechanism is designed to be used either when the gun is in a non-use condition or when the sear 41 malfunctions, as in the event of breakage of pivot 192.

The safety mechanism comprises a shaft 402 that is freely journaled within the stationary sleeve 400. A barrel 408 is keyed to shaft 402 by means of a pin 409 and keyway 410; this arrangement would permit shaft 402 to move axially except that during normal operation such movement is precluded by a frustoconical mandrel 412 affixed to the rear end of shaft 402 and a shoulder 413 adjacent the front end of stationary sleeve 400. The space between barrel 408 and mandrel 412 is occupied by a sleeve 414 which has an inner diameter slightly smaller than the largest diameter of mandrel 412.

Figure 3:
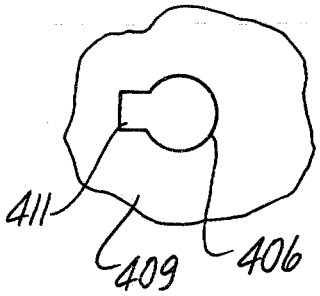
FIG. 3 is a fragmentary view showing the contour of an opening 406 in the rear wall of the bolt carrier 29.

Shaft 402 is capable of rotational adjustment in sleeve 400. Actual rotation of the shaft is accomplished by manual turning force on a handle 418 carried on barrel 408. FIG. 1 illustrates shaft 402 in one position of rotational adjustment; FIG. 2 illustrates the shaft in a second rotated position. Barrel 408 carries a radially projecting arm 416 which, in the position of FIG. 2, registers or aligns with trigger 40 to then prevent downward movement of the trigger. The front end of shaft 402 carries a swingable pawl 404 mounted on the shaft by means of a pivot pin 405. A leaf spring 407 normally biases pawl 404 to the extended position shown in FIG. 2. Aligned with shaft 402 is a non-circular keyhole opening 406 in the rear wall 409 of receiver 29; the contour of opening 406 is shown in FIG. 3. When shaft 402 is in the FIG. 1 rotated position of adjustment pawl 404 passes freely through slot portion 411 of the keyhold opening 406 so that the bolt carrier can move freely without restraint by the pawl. However when the shaft 402 is rotated (by handle 418) to the FIG. 2 position pawl 404 is aligned with the circular portion of opening 406 so that wall 409 of the bolt carrier exerts a trip action on the pawl as the bolt carrier moves rearwardly to the FIG. 2 position. The pawl then prevents forward motion of the bolt carrier in the direction of arrow C. R.

When the gun is firing the operating spring 200 and the compressed buffer spring mechanism 38 periodically impose high axial forces on the bolt carrier 29. Such high forces can produce failure of the sear 41, in which event pawl 404 serves as a safety back-up latch means to preclude undesired runaway motion of the bolt carrier in the C. R. direction. Preferably the safety mechanism incorporates a cushioning feature to minimize the load force on pawl 404 during this potential runaway period. In the illustrated mechanism the cushioning structure is provided by the sleeve 414. Thus, high axial force engagement between wall 409 and the edge of pawl 404 causes shaft 402 to be moved forwardly (rightwardly), during which time the mandrel 412 swages or enlarges the sleeve 414. This swage action absorbs the kinetic energy in the forwardly-moving bolt carrier 29 and gradually halts the movement before or when mandrel 412 strikes barrel 408. Sleeve 414 is a throwaway item that must be replaced before the gun is put back in service.

Arm structure 416 is intended to function as a safety stop means for restricting the trigger 40 to an inactive position disengaged from sear 41. When arm structure 416 is in the path of trigger 40, as shown in FIG. 2, the trigger cannot be operated to lift the sear 41 from its position aligned with shoulder 42. The sear therefore restrains the bolt carrier 29 in its full recoil position of FIG. 2. The two safety mechanisms, namely arm structure 416 and pawl 404, are both designed as safety devices to prevent movement of bolt carrier 29 from its FIG. 2 position. Arm structure 416 functions when sear 41 is operative; pawl 404 is a back-up device operable when the sear fails or malfunctions.

I wish it to be understood that I do not desire to be limited to the exact details of construction shown and described for obvious modifications will occur to a person skilled in the art.

I claim:

1. In an automatic gun comprising a receiver; a bolt carrier reciprocatable longitudinally in said receiver; a buffer assembly mounted at the rear of the receiver in the path of the bolt carrier for buffering the recoil force generated by the bolt carrier during movement thereof in the recoil direction; a shoulder (42) upstanding from the bolt carrier and a spring-urged sear (41) carried by the buffer assembly for engaging the shoulder to latch the carrier against movement in the counter-recoil direction; and a trigger swingably mounted at the rear end of the receiver for lifting the sear out of operative alignment with the shoulder, whereby the receiver is then enabled to undergo movement in the counter-recoil direction: the improvement comprising safety stop means for restricting the trigger to an inactive position disengaged from the sear; said safety stop means comprising an arm structure swingably mounted on the receiver for movement between a first active position in the path of the trigger to a second inactive position out of the path of the trigger, and a handle connected to said arm structure for moving same between its first and second positions; a disengageable safety latch movable from a first position restraining the bolt carrier against counter-recoil movement to a second position out of operative alignment with the bolt carrier; and means operatively interconnecting the stop means and latch so that the arm structure is in its active position when the latch is in its carrier-restraining position.

2. The improvement of claim 1: said interconnecting means comprising a rotary shaft extending along the swing axis of the arm structure, whereby manual turning movement of the arm structure produces rotational movement of the shaft; said safety latch comprising a pawl mounted on the shaft for pivotal movement on an axis transverse to the shaft axis.

3. The improvement of claim 2: the bolt carrier having a non-circular opening oriented so that when the aforementioned shaft is in one rotated position the pawl passes freely through the non-circular opening, and when the shaft is in a second rotated position the pawl trips on the surface of said opening to latch the bolt carrier against counter-recoil movement.

4. The improvement of claim 2: said rotary shaft being restrained against axial motion by means of a surrounding swagable sleeve; said shaft having an enlarged mandrel thereon engaged with an end surface of the sleeve; said mandrel having an outer diameter that is slightly larger than the inner diameter of the sleeve, whereby high axial forces imposed on the shaft by the bolt carrier cause the mandrel to move through the sleeve to swage the sleeve inner surface and thus absorb the high axial forces.

5. In an automatic gun comprising a receiver; a bolt carrier reciprocatable longitudinally in said receiver; a buffer assembly mounted at the rear of the receiver in the path of the bolt carrier for buffering the recoil force generated by the bolt carrier during movement thereof in the recoil direction; a shoulder (42) upstanding from the bolt carrier and a spring-urged sear (41) carried by the buffer assembly for engaging the shoulder to latch the carrier against movement in the counter-recoil direction; and a trigger swingably mounted at the rear end of the receiver for lifting the sear out of operative alignment with the shoulder, whereby the receiver is then enabled to undergo movement in the counter-recoil direction:

the improvement comprising a bearing sleeve affixed to the rear wall of the receiver with its axis parelleling the movement path of the bolt carrier; a shaft rotatably journaled in the bearing sleeve; a safety pawl mounted on the front end of the shaft for pivotal movement around an axis transverse to the shaft axis; the bolt carrier having a non-circular opening in its rear wall, whereby when the shaft is in one rotated position the carrier rear wall passes across the pawl without contacting same, and when the shaft is in a second rotated position the carrier rear wall passes across the pawl with a trip action thereon; a barrel keyed axially to the shaft at the rear end of the bearing sleeve; a mandrel carried by the shaft in axially spaced relation to the barrel; a swagable sleeve interposed between the mandrel and barrel whereby high axial impact forces imposed on the shaft by the bolt carrier cause the mandrel to swage the inner surface of the associated sleeve to thereby absorb and cushion the forces; an arm structure projecting radially from the barrel to a position in the path of the trigger when the shaft is in one rotated position; and a handle projecting from the barrel to permit manual rotation of the barrel and associated shaft.

* * * * *